US007746164B2

(12) United States Patent
Ogiwara et al.

(10) Patent No.: US 7,746,164 B2
(45) Date of Patent: Jun. 29, 2010

(54) VOLTAGE GENERATING CIRCUIT

(75) Inventors: Ryu Ogiwara, Kanagawa-ken (JP); Daisaburo Takashima, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/027,699

(22) Filed: Feb. 7, 2008

(65) Prior Publication Data

US 2008/0191792 A1 Aug. 14, 2008

(30) Foreign Application Priority Data

Feb. 8, 2007 (JP) ..... 2007-029326

(51) Int. Cl.
*G05F 1/10* (2006.01)
*G05F 3/02* (2006.01)

(52) U.S. Cl. ..... 327/541; 327/538; 323/267; 323/268; 323/316

(58) Field of Classification Search ..... 327/148, 327/157, 530, 538–541, 543; 323/305–317, 323/265–268; 363/59, 60
See application file for complete search history.

(56) References Cited

U.S. PATENT DOCUMENTS

| | | | | |
|---|---|---|---|---|
| 6,218,900 | B1 * | 4/2001 | Nolan | 330/255 |
| 6,232,753 | B1 * | 5/2001 | Pasotti et al. | 323/267 |
| 6,677,809 | B2 * | 1/2004 | Perque et al. | 327/541 |
| 2005/0162218 | A1 * | 7/2005 | Noda et al. | 327/541 |
| 2008/0061865 | A1 * | 3/2008 | Koerner | 327/512 |

OTHER PUBLICATIONS

Wikipedia—Comparator http://en.wikipedia.org/wiki/Comparator.*

* cited by examiner

*Primary Examiner*—Lincoln Donovan
*Assistant Examiner*—Brandon S Cole
(74) *Attorney, Agent, or Firm*—Oblon, Spivak, McClelland, Maier & Neustadt, L.L.P.

(57) ABSTRACT

Disclosed is a voltage generating circuit which steps down a voltage to output a stepped down voltage. The voltage generating circuit includes first and second transistors. The drains of the first and second transistors are connected to a higher voltage power supply. The gate of the first transistor is connected to the gate of the second transistor. The voltage of the gate of the first transistor is controlled by a control circuit such that a voltage of the source of the first transistor can reach a predetermined voltage. A stepped down voltage is outputted from the source of the second transistor.

5 Claims, 7 Drawing Sheets

VOLTAGE GENERATING CIRCUIT

CROSS REFERENCE TO RELATED APPLICATION

The application is based upon and claims the benefit of priority from the prior Japanese Patent Application No. 2007-29326, filed on Feb. 8, 2007, the entire contents of which are incorporated herein by reference.

FIELD OF THE INVENTION

The present invention relates to a voltage generating circuit to be used in such devices as semiconductor memory devices or SoC (System on a chip) devices.

DESCRIPTION OF THE BACKGROUND

Voltage generating circuits are widely used in semiconductor memory devices, SoC devices, and the like. In accordance with the progress of the micro-fabrication, low voltage operation and high integration of semiconductor elements, a voltage generating circuit is mounted together with such a device on a semiconductor chip to generate a voltage of a different level from that of a power supply voltage, which is supplied from the outside. The generated voltage, serving as an internal power supply voltage, is supplied to other circuits in the semiconductor chip.

Such a voltage generating circuit includes a step-down circuit that steps down the power supply voltage supplied from the outside, and a booster circuit that boosts the power supply voltage supplied from the outside.

As a step-down circuit, a voltage generating circuit such as a series regulator is known for use in a standby mode, for example, where current is less supplied. In addition, as another kind of step-down circuit, a source follower type voltage generating circuit is known. The source follower type voltage generating circuit is used in a mode for flowing current, for example, an active mode.

A source follower type voltage generating circuit is disclosed in Japanese Patent Application Publication No. 2003-178584 (Page 8, FIG. 10). The source follower type a voltage generating circuit is provided with an output transistor and a mirror transistor. The mirror transistor is of the same type as the output transistor, and is provided at the preceding stage of the output transistor.

The mirror transistor and the output transistor are supplied with a voltage of an outer power supply $V_{DD}$. The outer power supply $V_{DD}$ is supplied to the drain of the output transistor. The gate of the mirror transistor is connected to the drain of the mirror transistor. The gates of the output transistor and the mirror transistor are connected to each other. The gate voltage of the mirror transistor is maintained at a constant level. The circuit structure allows the output transistor to output a stepped-down internal power supply voltage.

The source follower type voltage generating circuit is configured to equalize the internal power supply voltage stepped down by the output transistor with the source voltage of the mirror transistor.

However, as will be described below, the output transistor and the mirror transistor show different characteristics in the case the voltage of the outer power supply $V_{DD}$ is high. Accordingly, a problem arises that a difference occurs in current amount per unit width between the output transistor and the mirror transistor.

The phenomenon of showing the different characteristics will be specifically described with reference to FIG. 10.

FIG. 10 is load curves showing a relationship between a current value which flows through a source follower type voltage generating circuit and a gate-source voltage $V_{GS}$ of an output transistor and a mirror transistor. FIG. 10 shows the relationship when a voltage of an outer power supply $V_{DD}$ is high. A curve 10 shows a load characteristic of the mirror transistor. A curve 11 shows a load characteristic of the output transistor. In FIG. 10A, current value 20 shows the maximum load current value. A current value 21 shows the minimum load current value. A point 22 shows a current of the mirror transistor and a gate-source voltage $V_{GS}$ in a standby state respectively.

Thus, when the voltage of the voltage power supply $V_{DD}$ is high, a difference in load characteristics occurs between the mirror transistor and the output transistor, which outputs a voltage stepped-down from the voltage of the power supply $V_{DD}$.

Accordingly, a relationship between a load current Ifk1 of the mirror transistor in a standby state and a load current Ifk2 of the output transistor to step down the voltage $V_{DD}$ is defined as follows:

$$Ifk2>Ifk1 \quad (1)$$

Moreover, in order to obtain a gate-source voltage $V_{GS}$ in a load current maximum region which is in an active state, a relationship between a load current Ifk1*a* of the mirror transistor and a load current Ifk2*a* of the output transistor that steps down the power supply voltage is defined as follows:

$$Ifk2a>Ifk1a \quad (2)$$

Thus, a difference in the current amount per unit width occurs between the mirror transistor and the output transistor. The difference becomes remarkable with increase of a current amount of the voltage of the voltage power supply $V_{DD}$.

As a result, the difference makes it difficult to maintain the source voltage of the mirror transistor at a predetermined value by controlling the gate voltage of the mirror transistor.

SUMMARY OF THE INVENTION

An aspect of the present invention provides a voltage generating circuit including: at least one first insulated-gate field-effect transistor having a source, a drain and a gate, the drain being connected to a first higher voltage power supply, and the source being connected to a first lower voltage power supply; a second insulated-gate field-effect transistor having a source, a drain and a gate, the drain being connected to a second higher voltage power supply and the gate being connected to a the gate of the first insulated-gate field-effect transistor; and a control circuit that controls a voltage of the gate of the first insulated-gate field-effect transistor such that a voltage of the source of the first insulated-gate field-effect transistor can reach a predetermined voltage. In the voltage generating circuit, a voltage obtained by stepping down a voltage of the second higher voltage power supply is outputted from the source of the second insulated-gate field-effect transistor.

DETAILED DESCRIPTION OF THE INVENTION

Embodiments of the present invention will be explained with reference to the drawings.

Figure 1:
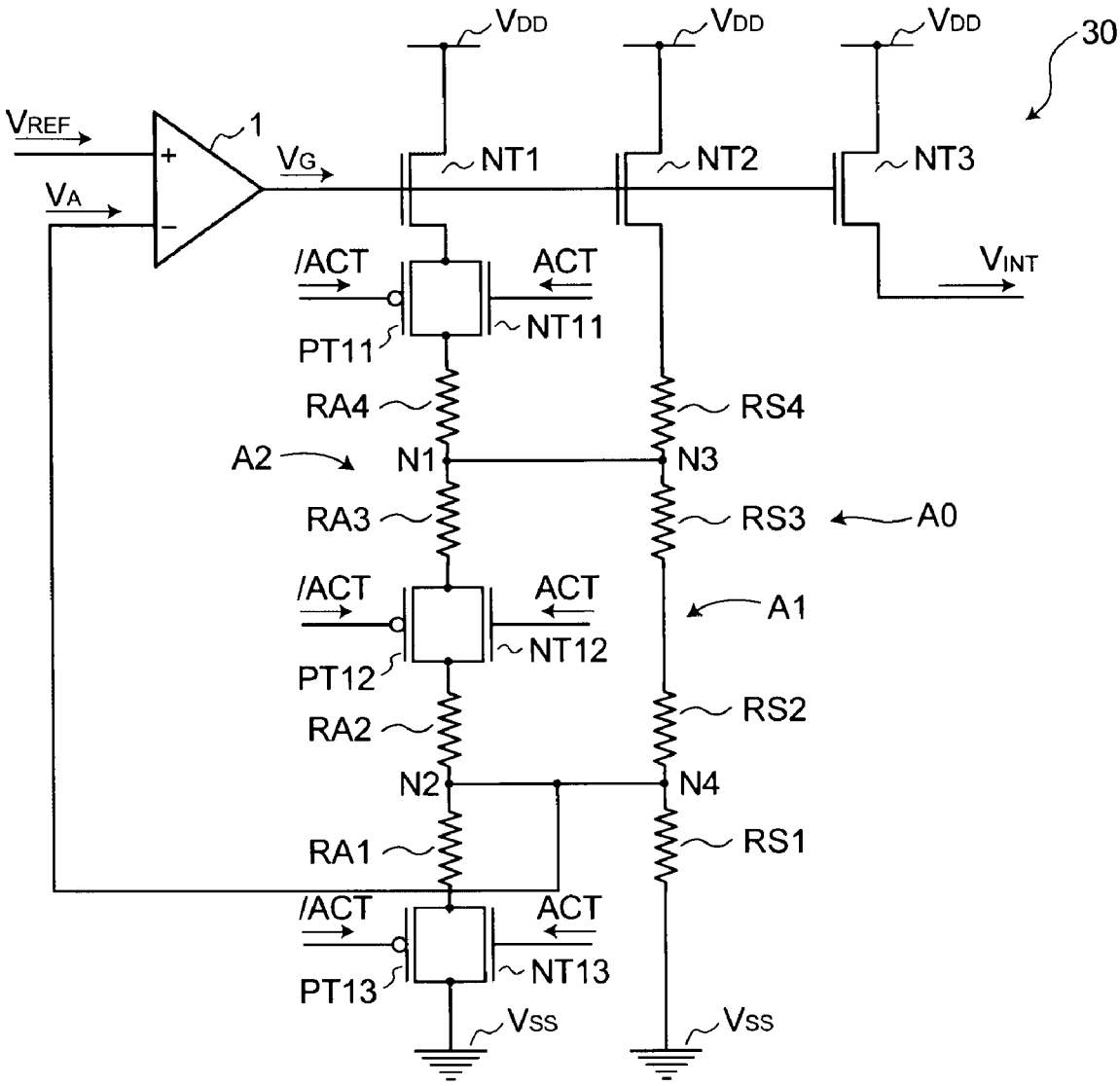
FIG. 1 is a circuit diagram showing a configuration of a voltage generating circuit according to a first embodiment of the present invention.
Figure 2:
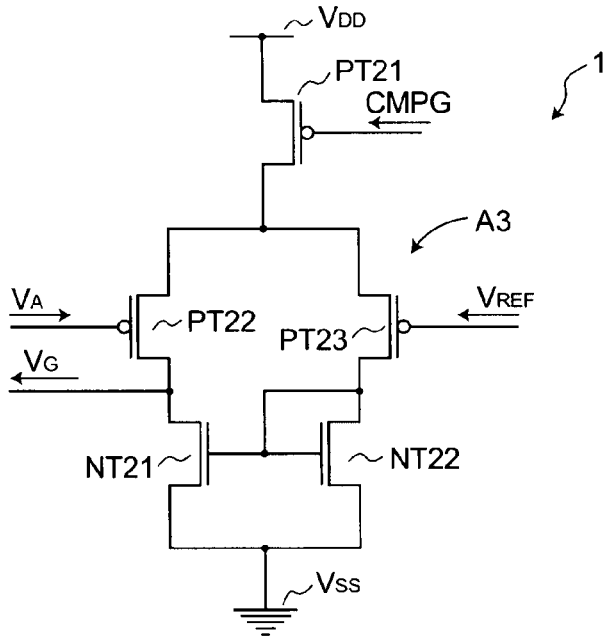
FIG. 2 is a circuit diagram showing a configuration of a differential amplifier circuit used in the voltage generating circuit in FIG. 1.

A first embodiment of the present invention will be explained with reference to FIGS. 1 and 2. FIG. 1 is a circuit diagram showing a configuration of a voltage generating circuit according to the first embodiment of the present invention. FIG. 2 is a circuit diagram showing a configuration of a differential amplifier circuit used in the voltage generating circuit in FIG. 1.

As show in FIG. 1, a voltage generating circuit 30 of the first embodiment includes a differential amplifier circuit 1, N-channel insulated-gate field-effect transistors (hereinafter referred to as "MIS transistors") NT1 to NT3, N-channel MIS transistors NT11 to NT13, P-channel MIS transistors PT11 to PT13, resistors RA1 to RA4, and resistors RS1 to RS4.

The voltage generating circuit 30 of the embodiment is provided in an interior of a semiconductor memory device, for example, which constitutes a semiconductor chip.

A voltage of a higher voltage power supply $V_{DD}$ is inputted to the voltage generating circuit 30 from the outside.

The N-channel MIS transistor NT1 serves as a first MIS transistor. The drain of the N-channel MIS transistor NT1 is connected to a higher voltage power supply $V_{DD}$, which is used as a first higher voltage power supply. The gate of the MIS transistor NT1 is connected to the differential amplifier circuit 1.

An output voltage (gate voltage) VG of the differential amplifier circuit 1 is inputted to the gate of the N-channel MIS transistor NT1. The N-channel MIS transistor NT1 functions as a mirror transistor.

The N-channel MIS transistor NT2 serves as another first MIS transistor. The drain of the N-channel MIS transistor NT2 is connected to a higher voltage power supply $V_{DD}$ which is used as a first higher voltage power supply. The gate of the N-channel MIS transistor NT2 is connected to the differential amplifier circuit 1. The output voltage (gate voltage) VG of the differential amplifier circuit 1 is inputted to the gate of the N-channel MIS transistor NT2. The N-channel MIS transistor NT2 functions as a mirror transistor.

The N-channel MIS transistor NT3 serves as a second MIS transistor. The drain of the N-channel MIS transistor NT3 is connected to a higher voltage power supply $V_{DD}$ serving as the second higher voltage power supply. The gate of the N-channel MIS transistor NT3 is connected to the differential amplifier circuit 1. In the embodiment, the voltage of the higher voltage power supply $V_{DD}$ serving as a second higher voltage power supply is substantially the same as that of the higher voltage power supply $V_{DD}$ serving as the first higher voltage power supply.

The output voltage (gate voltage) VG of the differential amplifier circuit 1 is inputted to a gate of the N-channel MIS transistor NT3. The N-channel MIS transistor NT 3 serves as a source follower type output transistor. The N-channel MIS transistor NT 3 outputs an output voltage VINT as a stepped-down internal power supply voltage.

The output voltage VINT serves as an internal power supply voltage to supply to other circuits provided in the semiconductor memory device.

The drain of the N-channel MIS transistor NT11 is connected to the source of the N-channel MIS transistor NT1, and the source is connected to one end of the resistor RA4. A control signal ACT is inputted to a gate of the MIS transistor NT11.

The source of the P-channel MIS transistor PT11 is connected to the source of the N-channel MIS transistor NT1, and the drain is connected to one end of the resistor RA4. A control signal/ACT is inputted to the gate of the MIS transistor PT11. The control signal/ACT is an opposite phase signal of a control signal ACT.

The N-channel MIS transistor NT11 and the P-channel MIS transistor PT11 function as transfer gates. The N-channel MIS transistor NT11 and the P-channel MIS transistor PT11 turn "ON" when the control signal ACT is in a "High" level (control signal/ACT is in a "Low" level). The other end of the resistor RA4 is connected a node N1. One end of the resistor RA3 is connected to the node N1.

The drain of the N-channel MIS transistor NT12 is connected to the other end of the resistor RA3. The source of the N-channel MIS transistor NT12 is connected to one end of the resistor RA2. A control signal Act is inputted to the gate of the MIS transistor NT12. The source of the P-channel MIS transistor PT12 is connected to the other end of the resistor RA3. The drain of the P-channel MIS transistor PT12 is connected to one end of the resistor RA2. A control signal/ACT is inputted to the gate of the MIS transistor PT12.

The N-channel MIS transistor NT12 and the P-channel MIS transistor PT12 function as transfer gates. The N-channel MIS transistor NT12 and the P-channel MIS transistor PT12 turn "ON" when the control signal ACT is in a "High" level (control signal/ACT is in a "Low" level). The other end of the resistor RA2 is connected a node N2. One end of the resistor RA1 is connected to the node N2.

The drain of the N-channel MIS transistor NT13 is connected to the other end of the resistor RA1. The source of the N-channel MIS transistor NT13 is connected to a lower voltage power supply $V_{ss}$ serving as a ground voltage. A control signal ACT is inputted to the gate of the MIS transistor NT13. The source of the P-channel MIS transistor PT 13 is connected to the other end of the resistor RA 1. The drain of the P-channel MIS transistor PT 13 is connected to the lower voltage power supply $V_{ss}$. A control signal/ACT is inputted to the gate of the MIS transistor PT13.

The N-channel MIS transistor NT13 and the P-channel MIS transistor PT13 function as transfer gates. The N-channel MIS transistor NT13 and the P-channel MIS transistor PT13 turn "ON" when the control signal ACT is in a "High" level (control signal/ACT is in a "Low" level).

One end of the resistor RS4 is connected to the source of the N-channel MIS transistor NT2. The other end of the resistor RS4 is connected to nodes N1 and N3. One end of the resistor RS3 is connected to the node N3. The other end of the resistor RS3 is connected to one end of the resistor RS2. The other end of the resistor RS2 is connected to nodes N2 and N4. One end of the resistor RS1 is connected to the node N4. The other end of the resistor RS1 of is connected to a lower voltage power supply $V_{ss}$.

Here, in a circuit A1 that is composed of the N-channel MIS transistor NT2 and the resistors RS1 to RS4, a current normally flows into the lower voltage power supply $V_{ss}$. In a circuit A2 that is composed of the N-channel MIS transistor NT1, the resistors RA1 to RA4, the MIS transistors NT11 to NT13 and PT11 to PT13, the current flows into the lower voltage power supply $V_{ss}$ in an active state. The active state is maintained, when the control signal ACT is in a "High" level and the control signal/Act is in a "Low" level. The circuits A1 and A2 operate as monitor circuits to detect a source voltage of the MIS transistor NT1. The circuits A1, A2 and the differential amplifier circuit 1 form a feedback circuit A0 as a control circuit to control voltage to be applied to the gate based on the source voltage of the MIS transistor NT1.

The voltage of the nodes N2 and N4 serves as a feedback voltages VA, and is inputted to the "– (minus)" port on the input side of the differential amplifier circuit 1.

The differential amplifier circuit 1 is configured as shown in FIG. 2. The differential amplifier circuit 1 includes N-channel MIS transistors NT21 and NT22, and P-channel MIS transistors PT21 to PT23.

The gate of the MIS transistor PT23 serves as the "+ (plus)" port on the input side of the differential amplifier circuit 1. A reference voltage VREF, as a reference signal, is inputted to the gate of the MIS transistor PT23.

The gate of the MIS transistor PT22 serves as the "– (minus)" port on the input side of the differential amplifier circuit 1. The feedback voltage VA is inputted to the gate of the MIS transistor PT22.

The source of the P-channel MIS transistor PT21 is connected to the higher voltage power supply $V_{DD}$. A control signal CMPG functions as a constant current source. The control signal CMPG is inputted to a gate of the MIS transistor PT21.

The source of the P-channel MIS transistor PT22 is connected to the drain of the P-channel MIS transistor PT21. The source of the P-channel MIS transistor PT23 is connected to the drain of the P-channel MIS transistor PT21.

Gates of the MIS transistors NT21 and NT22 are connected to each other. Drains of the NT21 and NT22 are connected to a lower voltage power supply $V_{ss}$. The gate of the MIS transistor NT22 is connected to the drain.

Here, the MIS transistors PT22, PT23, NT21 and NT22 constitute a current mirror circuit A3. The P-channel MIS transistors PT22 and PT23 are input transistors.

A differentially amplified signal, as an output (gate voltage) VG, is outputted from a node N5 that connects the drains of the MIS transistor PT22 and the MIS transistor NT21.

Here, when the feedback voltage VA is lower than the reference voltage VREF, the output voltage (gate voltage) VG becomes a "High" level. When the feedback voltage VA is higher than the reference voltage VREF, the output voltage (gate voltage) VG becomes a "Low" level. As a reference voltage VREF, an output voltage from a BGR (Band Gap Reference) circuit is used, for example. The output voltage has a high accuracy and extremely low coefficients of voltage and temperature.

In the embodiment, the gate and drain of each of the MIS transistors NT1 and NT2 serving as a mirror transistor are not connected to each other. In the embodiment, the output voltage VG of the differential amplifier circuit 1 is supplied commonly to the respective gates of the MIS transistors NT1, NT2 and of the MIS transistor NT3 stepping down the power voltage.

As a result, the internal power supply voltage, which is stepped down from the power voltage $V_{DD}$ by the MIS transistor NT3, can be equalized to the source voltage of each of the MIS transistors NT1 and NT2.

In the embodiment, the MIS transistors NT1, NT2 and NT3 are set to have currents flowing with the same current value normalized on the basis of a gate width dimension W and a gate length dimension L (W/L).

The makes it possible to equalize a potential difference between the drain and source of each of the MIS transistors NT1, NT2, MIS transistor NT3. The allows the output voltage VINT, as a stepped-down internal power supply voltage, to be accurately controlled.

Figure 3:
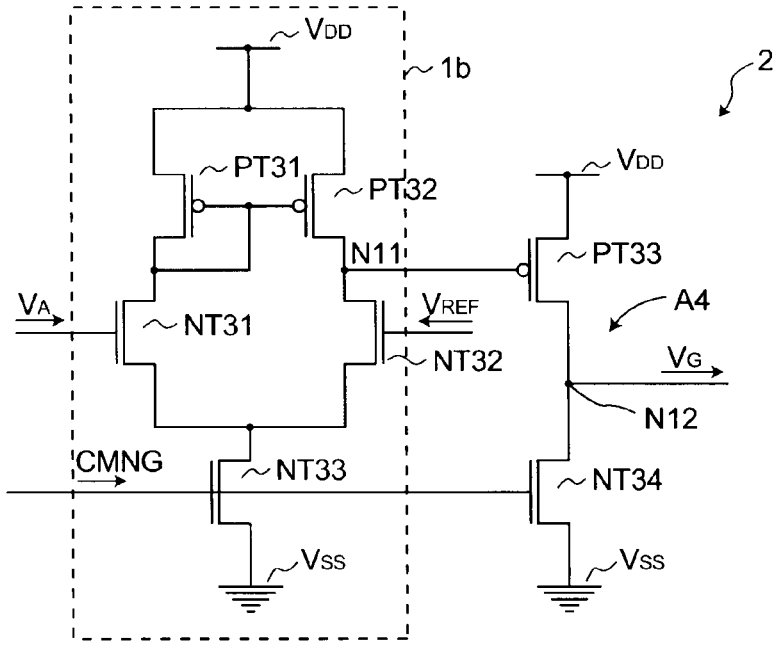
FIG. 3 is a circuit diagram showing a configuration of a gate voltage generating section in a voltage generating circuit according to a second embodiment of the present invention.

A voltage generating circuit of a second embodiment of the invention will be explained with reference to FIG. 3. FIG. 3 is a circuit diagram showing a configuration of a gate voltage generating section in the voltage generating circuit according to the second embodiment.

The same configuration components in FIG. 3 as those in the first embodiment are assigned the same reference numerals as those in the first embodiment.

In the embodiment, a gate voltage generating section is provided in place of the differential amplifier circuit used in the first embodiment.

As shown in FIG. 3, a gate voltage generating section 2 is provided with a series circuit A4 including a differential amplifier circuit 1*b*, N-channel MIS transistor NT34 and a P-channel MIS transistor PT33.

The differential amplifier circuit 1*b* includes N-channel MIS transistors NT31 to NT33 and P-channel MIS transistors PT31 and PT32.

The source of the P-channel MIS transistor PT31 is connected to a higher voltage power supply $V_{DD}$. The gate of the MIS transistor PT 31 is connected to the drain thereof.

The source of the P-channel MIS transistor PT32 is connected to the higher voltage power supply $V_{DD}$. The gate of the MIS transistor PT 32 is connected to the gate of the P-channel MIS transistor PT31, and the drain thereof is connected to a node N11.

The P-channel MIS transistors PT31 and PT32 operate as current mirror circuits.

The drain of the N-channel MIS transistor NT31 is connected to the drain of the P-channel MIS transistor PT31. A feedback voltage VA is inputted to a (+ (plus)) port on one input side of the differential amplifier circuit 1*b*. As a result, the input feedback voltage VA is inputted to a gate of the MIS transistor NT31.

The drain of the N-channel MIS transistor NT32 is connected to the node N11. A reference voltage VREF is inputted to the (– (minus)) port on other input side of the differential amplifier circuit 1*b*. As a result, the reference voltage VREF is inputted to the gate of the MIS transistor NT32.

The N-channel MIS transistors NT31 and NT32 are input transistors. A differentially amplified signal is outputted from the node N11.

The drain of the N-channel MIS transistor NT33 is connected to the sources of the N-channel MIS transistors NT31 and N32. The source of the MIS transistor NT33 is connected to a lower voltage power supply Vss. A control signal CMNG, which operates as a constant current source, is inputted to the gate of the MIS transistor NT33.

Here, when the feedback voltage VA is lower than the reference voltage VREF, an output voltage (gate voltage) VG becomes a "High" level. When the feedback voltage VA is higher than the reference voltage VREF, the output voltage (gate voltage) VG becomes a "Low" level. As a reference voltage VREF, voltage is used, which is outputted from, for example, a BGR (Band Gap Reference) circuit and has a high accuracy and extremely low coefficients of voltage and temperature.

The source of the P-channel MIS transistor PT33 is connected to a higher voltage power supply $V_{DD}$. A signal outputted from the node N11 is inputted to the gate of the MIS transistor PT33. The drain of the N-channel MIS transistor NT34 is connected to the drain of the P-channel MIS transistor PT33. The source of the MIS transistor NT34 is connected to a lower voltage power supply $V_{SS}$. A control signal CMNG is inputted to the gate of the MIS transistor NT34. The P-channel MIS transistor PT33 and N-channel MIS transistor NT34 perform an inverter operation to output an output voltage (gate voltage) VG, similar to the differential amplifier circuit 1 of the first embodiment.

In the embodiment, the differential amplifier circuit 1 used in the first embodiment is replaced with the gate voltage generating section 2. Therefore, the voltage generating circuit according to the embodiment performs the same operation as the voltage generating circuit 30 of the first embodiment and provides the same effects as those in the first embodiment.

Also, in the embodiment, the N-channel MIS transistors NT31 and NT32 are used as a differential pair of the differential amplifier circuit 1*b*, and therefore it is possible to manufacture these transistors in the same process as the differential amplifier used in another circuit (not shown).

In the embodiment, the P-channel MIS transistors PT31 and PT32 are connected between the higher voltage power supply $V_{DD}$ and the N-channel MIS transistors NT31 and NT32. Load resistors may be connected in place of the P-channel MIS transistors PT31 and PT32, respectively.

A voltage generating circuit of a third embodiment of the invention will be explained with reference to FIGS. 4 and 5.

Figure 4:
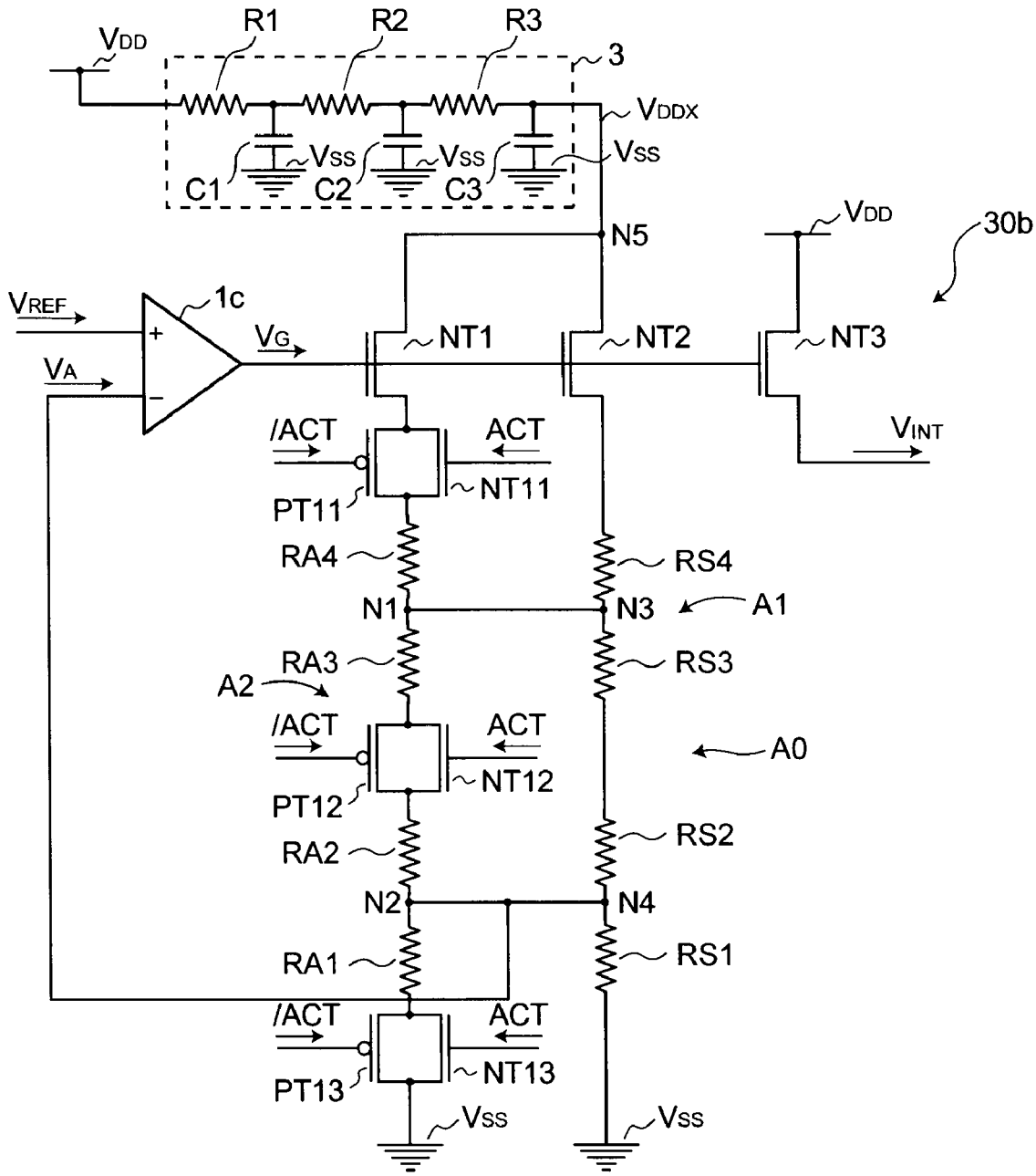
FIG. 4 is a circuit diagram showing a configuration of a voltage generating circuit according to a third embodiment of the present invention.

FIG. 4 is a circuit diagram showing a configuration of the voltage generating circuit. FIG. 5 is a circuit diagram showing a configuration of a differential amplifier circuit used in the voltage generating circuit.

Figure 5:
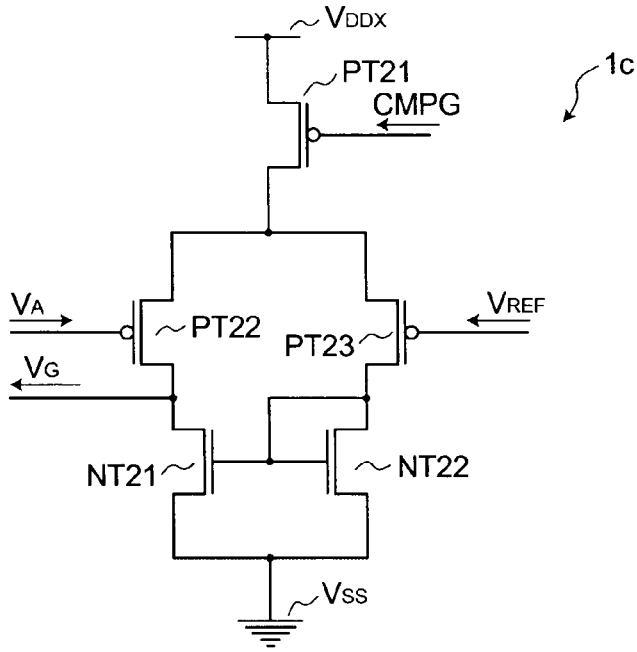
FIG. 5 is a circuit diagram showing a configuration of a differential amplifier circuit used in the voltage generating circuit in FIG. 4.

The same configuration components in FIGS. 4 and 5 as those in FIGS. 1 and 2 are assigned the same reference numerals as those in FIGS. 1 and 2.

In the embodiment, a RC circuit is provided to suppress voltage fluctuations of a higher voltage power supply.

As shown in FIG. 4, a voltage generating circuit 30*b* of the embodiment includes a differential amplifier circuit 1*c*, a RC circuit 3, N-channel MIS transistors NT1 to NT3, N-channel MIS transistors NT11 to NT13, P-channel MIS transistors PT11 to PT13, resistors RA1 to RA4, and resistors RS1 to RS4.

The voltage generating circuit 30*b* is provided in an interior of a semiconductor chip having, for example, a semiconductor memory device thereon. In the case, a voltage of a higher voltage power supply $V_{DD}$ is supplied externally to the semiconductor chip. The voltage is stepped down by the voltage generating circuit 30*b*. The stepped-down internal power supply voltage serving as an output voltage VINT is supplied to various types of circuits (not shown) provided in the semiconductor chip.

The RC circuit 3 includes capacitors C1 to C3 and resistors R1 to R3. One end of the resistor R1 is connected to a higher voltage power supply $V_{DD}$. One end of the capacitor C1 is connected to the other end of the resistor R1. The other end of the capacitor C1 is connected to a lower voltage power supply $V_{SS}$. One end of the resistor R2 is connected to the other end of the resistor R1. One end of the capacitor C2 is connected to the other end of the resistor R2. The other end of the capacitor C2 is connected to a lower voltage power supply $V_{SS}$. One end of the resistor R3 is connected to the other end of the resistor R2. The other end of the resistor R3 is connected to a node N5. One end of the capacitor C3 is connected to the other end of the resistor R3. The other end of the capacitor C3 is connected to a lower voltage power supply $V_{SS}$.

The RC circuit 3 is connected between the higher voltage power supply $V_{DD}$ and the node N5. The RC circuit 3 suppresses fluctuations in voltage of the higher voltage power supply $V_{DD}$ serving as a power supply voltage supplied externally. The RC circuit 3 outputs, to the node N5, the voltage of a higher voltage power supply $V_{DDX}$ having suppressed voltage fluctuation, which serves as a second higher voltage power supply.

The drain of the N-channel MIS transistor NT1 is connected to the node N5. The gate of the MIS transistor NT1 is connected to the differential amplifier circuit 1*c*. The voltage of the higher voltage power supply $V_{DDX}$ is inputted to the drain of the N-channel MIS transistor NT1. An output voltage (gate voltage) VG outputted from the differential amplifier circuit 1*c* is inputted to the gate of the MIS transistor NT1. The MIS transistor NT1 functions as a mirror transistor.

The drain of the N-channel MIS transistor NT2 is connected to the node N5. The gate of the MIS transistor NT2 is connected to the differential amplifier circuit 1*c*. The voltage of the higher voltage power supply $V_{DDX}$ is inputted to the drain of the N-channel MIS transistor NT2. The output voltage (gate voltage) VG outputted from the differential amplifier circuit 1*c* is inputted to the gate of the MIS transistor NT2. The MIS transistor NT2 functions as a mirror transistor.

As shown in FIG. 5, the differential amplifier circuit 1*c* has the same circuit configuration as that of the differential amplifier circuit 1 shown in FIG. 2. The higher voltage power supply $V_{DD}$ in FIG. 2 is replaced with another higher voltage power supply $V_{DDX}$. The differential amplifier circuit 1*c* performs the same operation as the differential amplifier circuit 1 in FIG. 2.

The voltage generating circuit 30*b* of the embodiment shown in FIG. 4 performs the same operation as the voltage generating circuit 30 in FIG. 1.

The voltage generating circuit 30*b* of the embodiment includes the RC circuit 3.

As a result, in addition to the same effects as those in the first embodiment, it is possible to supply and input stable voltage of the higher voltage power supply $V_{DDx}$ having suppressed voltage fluctuation even if voltage of the higher voltage power supply $V_{DD}$, serving as power supply voltage supplied externally, tends to fluctuate. Therefore, it is possible to stabilize the gate voltage of the MIS transistor NT1 to NT3 and maintain the voltage level constant.

Additionally, in the embodiment, the drain of the N-channel MIS transistor NT3, serving as a source follower type output transistor, is connected to the higher voltage power supply $V_{DD}$. However, the drain may be connected to the higher voltage power supply $V_{DDX}$.

Figure 6:
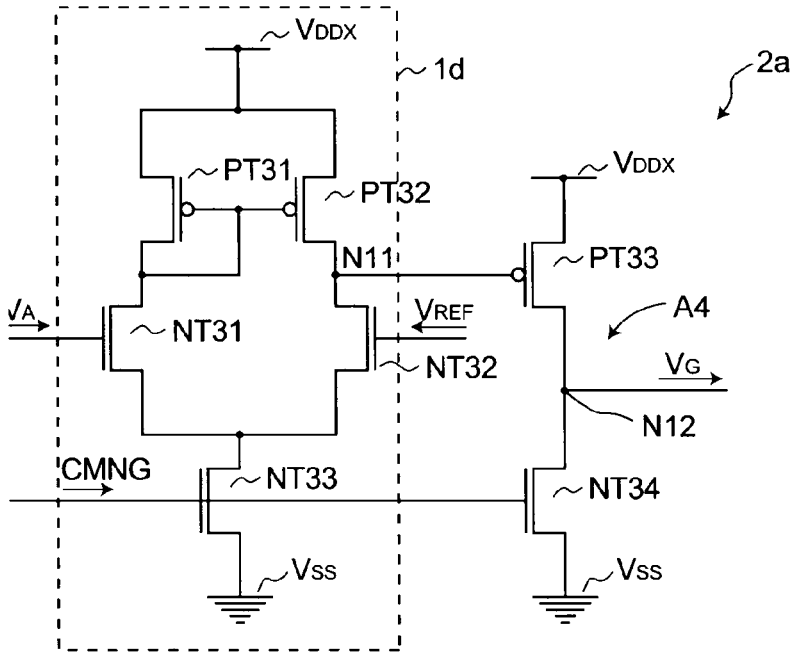
FIG. 6 is a circuit diagram showing a configuration of a gate voltage generating section in a voltage generating circuit according to a fourth embodiment of the present invention.

A voltage generating circuit of a fourth embodiment of the invention will be explained with reference to FIG. 6. FIG. 6 is a circuit diagram showing a configuration of a voltage generating section used in the voltage generating circuit according to the fourth embodiment. The same configuration components in FIG. 6 as those in FIG. 3 of the second embodiment are assigned the same reference numerals as those in FIG. 3.

In the embodiment, voltage of the higher voltage power supply to be supplied to the gate voltage generating section is a voltage of the higher voltage power supply $V_{DDX}$.

As shown in FIG. 6, a gate voltage generating section 2*a* of the embodiment is provided with a series circuit A5 including a differential amplifier circuit 1*d*, an N-channel MIS transistor NT34, and a P-channel MIS transistor PT33.

The differential amplifier circuit 1*d* includes N-channel MIS transistors NT31 to NT33 and P-channel MIS transistors PT31 and PT32. A feedback voltage VA is inputted to the (+ (plus)) port on the input side of the differential amplifier circuit 1*d*. A reference voltage VREF is inputted to the (− (minus)) port on the input side of the differential amplifier circuit 1*d*.

The source of the P-channel MIS transistor PT31 is connected to a higher voltage power supply $V_{DDX}$. The gate of the MIS transistor PT31 is connected to a drain thereof.

The source of the P-channel MIS transistor PT32 is connected to the higher voltage power supply $V_{DDX}$. The gate of the MIS transistor PT32 is connected to the gate of the P-channel MIS transistor PT31. The drain of the MIS transistor PT31 is connected to a node N11. The P-channel MIS transistors PT31 and PT32 operate as current mirror circuits. The source of the P-channel MIS transistor PT33 is connected to a higher voltage power supply $V_{DDX}$. An output signal of the node N11 is inputted to a gate of the MIS transistor PT33.

The N-channel MIS transistor NT34 and the P-channel MIS transistor PT33 are connected to each other by a node N12. The P-channel MIS transistor PT33 and N-channel MIS transistor NT34 perform an inverter operation to output an output voltage (gate voltage) VG from the node N12.

In the embodiment, the differential amplifier circuit 1*c* used in the second embodiment is replaced with the gate voltage generating section 2*a* in FIG. 5. The gate voltage generating section 2*a* performs the same operation as the differential amplifier circuit 1*c* in the second embodiment. The voltage generating circuit having the gate voltage generating section 2*a* in the embodiment performs the same operation as the voltage generating circuit 30 in the first embodiment.

Accordingly, the embodiment provides the same effects as those in the first and second embodiments. Moreover, in the embodiment, a differential pair of the differential amplifier circuit 1*d* is used as N-channel MIS transistors, and therefore it is possible to manufacture these transistors in the same process as the differential amplifier used in another circuit.

Figure 7:
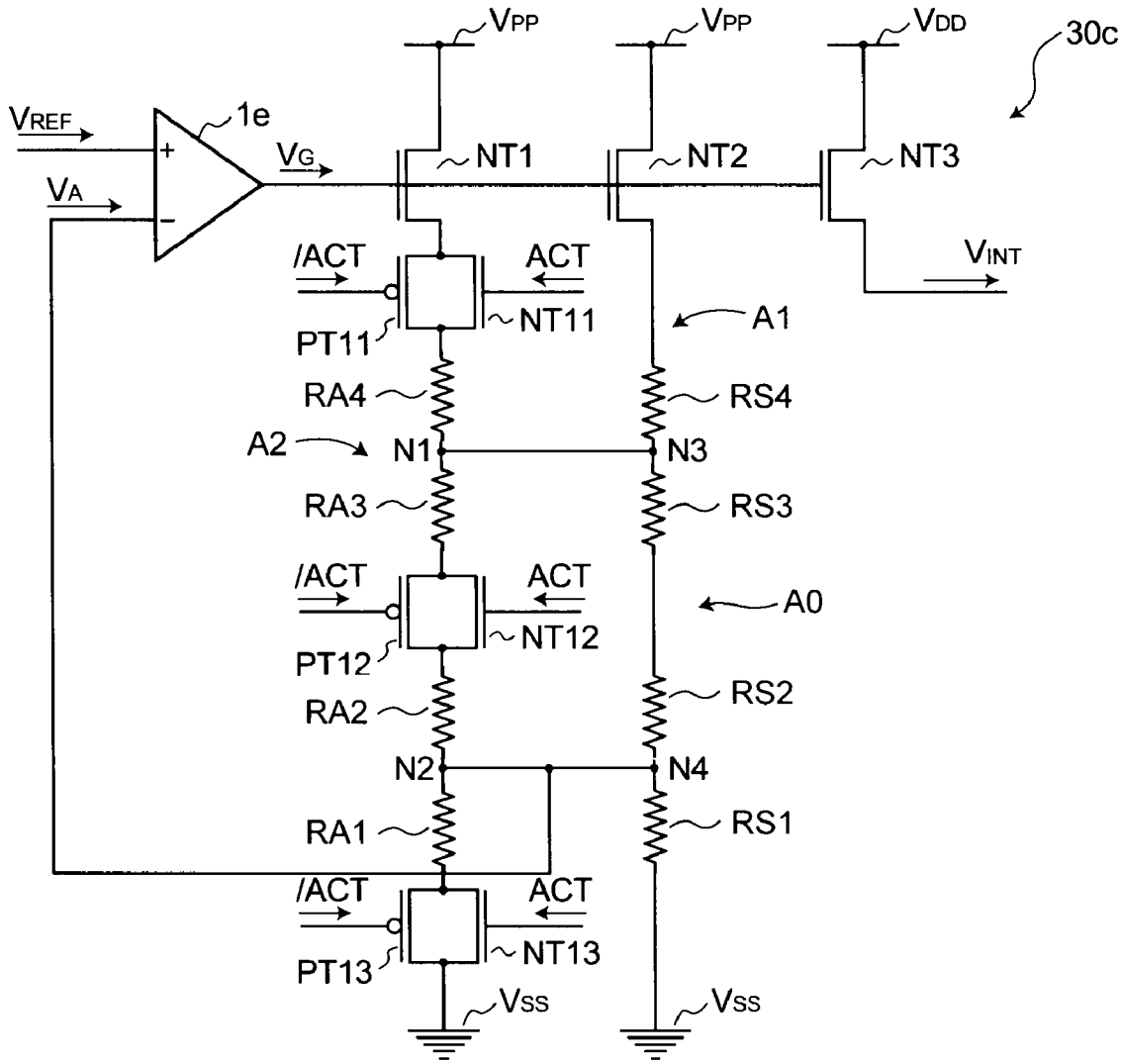
FIG. 7 is a circuit diagram showing a configuration of a voltage generating circuit according to a fifth embodiment of the present invention.
Figure 8:
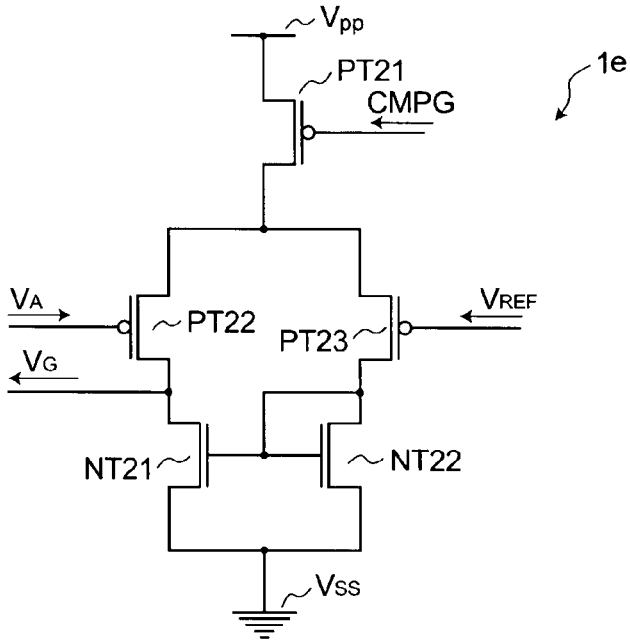
FIG. 8 is a circuit diagram showing a configuration of a differential amplifier circuit used in the voltage generating circuit in FIG. 7.

A voltage generating circuit of a fifth embodiment of the invention will be explained with reference to FIGS. 7 and 8. FIG. 7 is a circuit diagram showing a configuration of the voltage generating circuit of the fifth embodiment, and FIG. 8 is a circuit diagram showing a configuration of a differential amplifier circuit used in the voltage generating circuit in FIG. 7. The same configuration components in FIGS. 7 and 8 as those in the first embodiment are assigned the same reference numerals as those in the first embodiment.

In the embodiment, regarding voltage of the higher voltage power supply to be supplied to the voltage generating circuit, there is used a stable higher voltage power supply $V_{PP}$ as a word line boost power supply of a semiconductor memory device, for example.

As shown in FIG. 7, a voltage generating circuit 30*c* of the embodiment includes a differential amplifier circuit 1*e*, N-channel MIS transistors NT1 to NT3, NT11 to NT13, P-channel MIS transistors PT11 to PT13, resistors RA1 to RA4, and resistors RS1 to RS4. The voltage generating circuit 30*c* is provided in an interior of a semiconductor chip having, for example, a semiconductor memory device thereon. A stepped-down internal power supply voltage, serving as an output voltage VINT, is supplied to various types of circuits (not shown) provided in the semiconductor chip.

The drain of the N-channel MIS transistor NT1 is connected to, as a second higher voltage power supply, a higher voltage power supply $V_{PP}$ which is a word line boost power supply serving, for example. The gate of the MIS transistor NT1 is connected to the differential amplifier circuit 1*e*. The voltage of the higher voltage power supply $V_{PP}$ is inputted to the drain of the N-channel MIS transistor NT1. An output voltage (gate voltage) VG outputted from the differential amplifier circuit 1*e* is inputted to the gate of the MIS transistor NT1. The MIS transistor NT1 functions as a mirror transistor.

The drain of the N-channel MIS transistor NT2 is connected to a higher voltage power supply $V_{PP}$. The gate of the MIS transistor NT2 is connected to the differential amplifier circuit 1*e*. The voltage of the higher voltage power supply $V_{PP}$ is inputted to the drain of the N-channel MIS transistor NT2. An output voltage (gate voltage) VG outputted from the differential amplifier circuit 1*e* is inputted to the gate of the MIS transistor NT2. The MIS transistor NT2 functions as a mirror transistor.

As shown in FIG. 8, the differential amplifier circuit 1*e* includes N-channel MIS transistors NT21 and NT22 and P-channel MIS transistors PT21 to PT23.

A reference voltage VREF is inputted to the (+) port on the input side of the differential amplifier circuit 1*e*. A feedback voltage VA is inputted to the (−) port on the input side of the differential amplifier circuit 1*e*.

The differential amplifier circuit 1*e* outputs a differentially amplified signal as an output (gate voltage) VG, similar to the first embodiment. The source of the P-channel MIS transistor PT21 is connected to a higher voltage power supply $V_{PP}$. A control signal CMPG is inputted to the gate of the MIS transistor PT21. The MIS transistor PT21 functions as a constant current source.

The voltage generating circuit 30*c* of the embodiment provides the same effects as those in the first embodiment. Moreover, in the case where a level difference between voltage of the higher voltage power supply $V_{PP}$ and voltage, serving as an outer power voltage, of the higher voltage power supply $V_{DD}$ is small, even if the voltage of the higher voltage power supply $V_{DD}$ fluctuates, it is possible to receive supply of stable voltage of the higher voltage power supply $V_{PP}$ having suppressed voltage fluctuation. Thus, it is possible to stabilize the gate voltage of the MIS transistor NT1, NT2 and source follower type MIS transistor NT3, and maintain the voltage level constant.

Additionally, in the embodiment, the drain of the N-channel MIS transistor NT3, serving as a source follower type output transistor, is connected to the higher voltage power supply $V_{DD}$. The drain of the N-channel MIS transistor NT3 may be connected to the higher voltage power supply $V_{PP}$.

Figure 9:
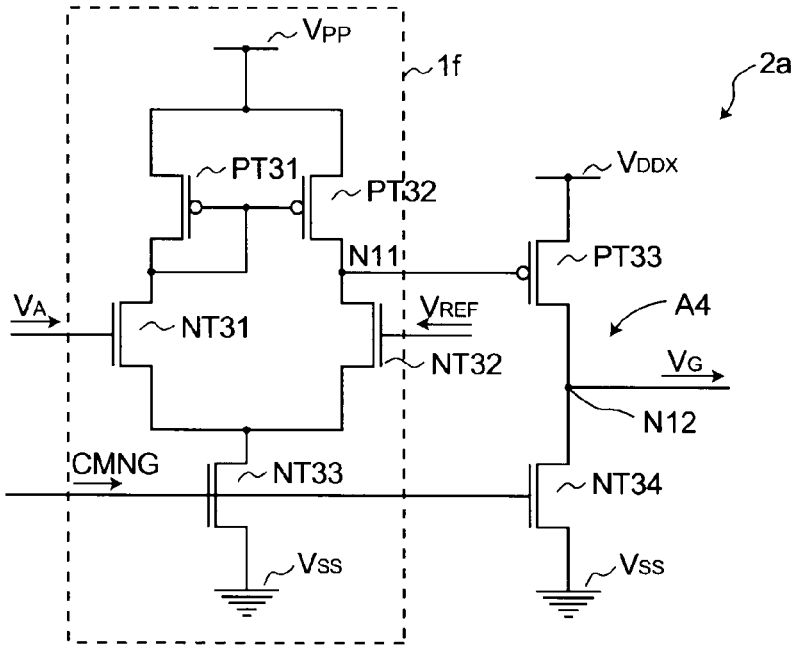
FIG. 9 is a circuit diagram showing a configuration of a gate voltage generating section in a voltage generating circuit according to a sixth embodiment of the present invention.
Figure 10:
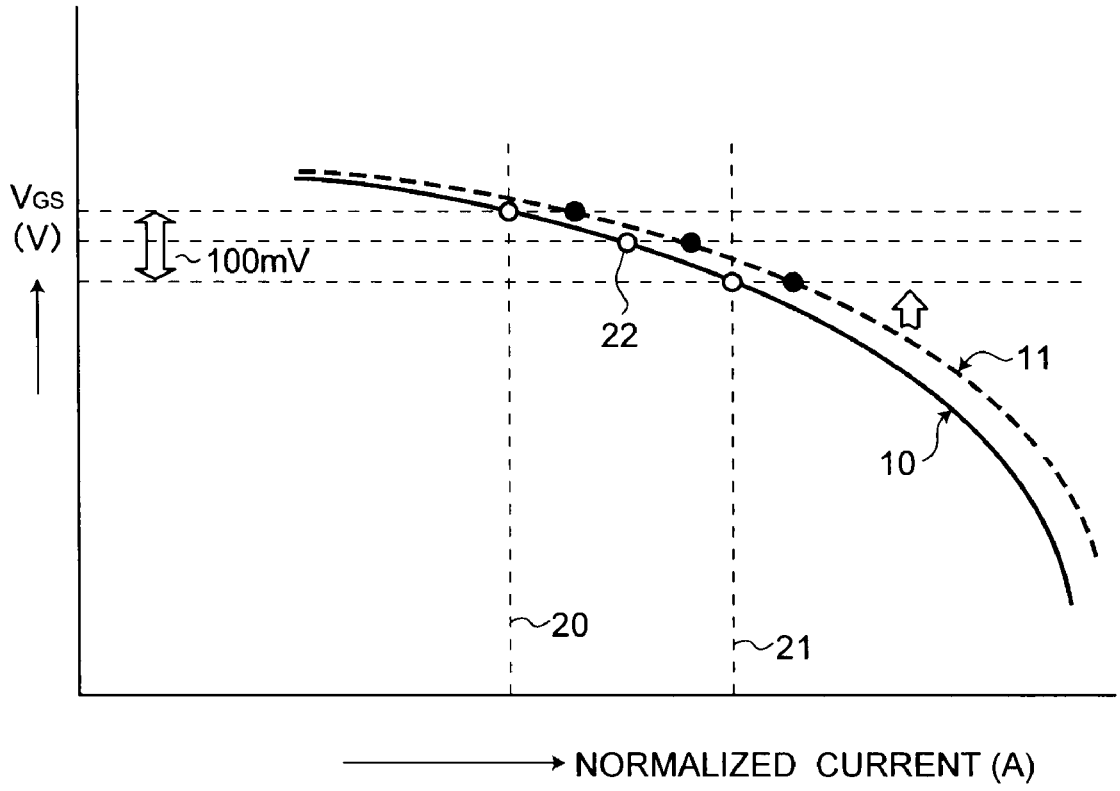
FIG. 10 shows load curves denoting relationships between current values and voltage values in a conventional voltage generating circuit.

A voltage generating circuit of a sixth embodiment of the invention will be explained with reference to FIG. 9. FIG. 9 is a circuit diagram showing a configuration of a voltage generating section used in the voltage generating circuit according to the sixth embodiment. The same configuration components in FIG. 9 as those in FIG. 3 are assigned the same reference numerals as those in FIG. 3.

In the embodiment, a higher voltage power supply to be supplied to the gate voltage generating section is changed.

As shown in FIG. 9, a gate voltage generating section 2*b* used in the voltage generating circuit according to the embodiment is provided with a series circuit A4 including a differential amplifier circuit 1*f*, an N-channel MIS transistor NT34, and a P-channel MIS transistor PT33.

The differential amplifier circuit 1*f* includes N-channel MIS transistors NT31 to NT33 and P-channel MIS transistors PT31 and PT32. The source of the P-channel MIS transistor PT31 is connected to a higher voltage power supply $V_{PP}$. The gate of the MIS transistor PT31 is connected to the drain thereof. The source of the P-channel MIS transistor PT32 is connected to the higher voltage power supply $V_{PP}$. The gate of the P-channel MIS transistor PT32 is connected to the gate of the P-channel MIS transistor PT31. The drain of the MIS transistor PT32 is connected to a node N11.

The P-channel MIS transistor PT31 and PT32, and the N-channel MIS transistors NT31 and NT32 operate as current mirror circuits. The source of the P-channel MIS transistor PT33 is connected to the higher voltage power supply $V_{PP}$. An output signal obtained from a node N11 is inputted to the gate of the MIS transistor PT33. A feedback voltage VA is inputted to the (+ (plus)) port on the input side of the differential amplifier circuit 1*f*. A reference voltage VREF is inputted to the (– (minus)) port on the input side of the differential amplifier circuit 1*f*.

As mentioned above, in the gate voltage generating section 2*b* of the voltage generating circuit of the embodiment, a voltage of the higher voltage power supply $V_{PP}$ having a stable voltage level, which serves as a word line boost power supply of a semiconductor memory device, is inputted to the sources of the P-channel MIS transistors PT31 and PT32. The voltage of the higher voltage power supply $V_{PP}$ is also inputted to the source of the P-channel MIS transistor PT33.

In the voltage generating circuit of the embodiment, the differential amplifier circuit 1*e* used in the fifth embodiment is replaced with the gate voltage generating section 2*b* in FIG. 9. The gate voltage generating section 2*b* performs the same operation as the differential amplifier circuit 1*e* used in the fifth embodiment. The voltage generating circuit having the gate voltage generating section 2*b* in the embodiment performs the same operation as the voltage generating circuit 30*c* in the fifth embodiment.

The embodiment provides the same effects as those in the second and fourth embodiments. Moreover, in the embodiment, a differential pair of the differential amplifier circuit 1*f* is used as N-channel MIS transistors, and thus it is possible to manufacture these transistors in the same process as the differential amplifier used in another circuit.

In each of the aforementioned embodiments, the voltage generating circuit generates a stepped-down voltage to be used in the semiconductor memory device. The voltage generating circuit may generate stepped-down voltage to be used in LSI circuits such as SoC (System on a chip) devices, analog and digital LSI circuits, and the like.

Other embodiments or modifications of the present invention will be apparent to those skilled in the art from consideration of the specification and practice of the invention disclosed herein. It is intended that the specification and example embodiments be considered as exemplary only, with a true scope and spirit of the invention being indicated by the following.

What is claimed is:

1. A voltage generating circuit comprising:

first insulated-gate field-effect transistors, each of the first insulated-gate field-effect transistors having a source, a drain and a gate, the drain being connected to a first higher voltage power supply, and the source being connected to a lower voltage power supply;

a second insulated-gate field-effect transistor having a source, a drain and a gate, the drain being connected to a second higher voltage power supply, and the gate being connected to the gates of the first insulated-gate field-effect transistors;

a first circuit having two terminals, one of the two terminals connecting with the source of one of the first insulated-gate field-effect transistors, the other of the two terminals connecting with the lower voltage power supply, the first circuit being provided with a transfer gate, first and second resistors connected in series with each other and a first node between the first and second resistors;

a second circuit having two terminals, one of the two terminals connecting with the source of one of the second insulated-gate field-effect transistors, the other of the two terminals connecting with the lower voltage power supply, the second circuit being provided with third and fourth resistors connected in series with each other and a second node between the third and fourth resistors connected with the first node; and a differential amplifier circuit having two input ports and an output node, one of the ports receiving a reference voltage, the other of the ports being given a voltage being obtained from the first and the second nodes, the output node providing an output voltage to the gates of the first insulated-gate field-effect transistors and the gate of second insulated-gate field-effect transistor.

2. A voltage generating circuit according to claim 1, wherein the transfer gate is set to an ON state in an active mode.

3. A voltage generating circuit according to claim 1, wherein the transfer gate is provided with P-channel and N-channel insulated-gate field-effect transistors connected in parallel with each other.

4. A voltage generating circuit according to claim 3, wherein the gates of the P-channel and N-channel insulated-gate field-effect transistors of the transfer are given low and high level control signals respectively in an active mode.

5. The voltage generating circuit according to claim 1, wherein the voltages of the first and second higher voltage power supplies are substantially same.

* * * * *